US010777917B2

(12) United States Patent
Wang et al.

(10) Patent No.: US 10,777,917 B2
(45) Date of Patent: Sep. 15, 2020

(54) TERMINAL STAND WITH MOVABLE PART THAT CAN ACTIVATE A METAL ELASTIC PART

(71) Applicant: P-TWO INDUSTRIES INC., Taoyuan (TW)

(72) Inventors: Chien-Chun Wang, Taoyuan (TW); Wen-Lun Wang, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 16/270,183

(22) Filed: Feb. 7, 2019

(65) Prior Publication Data

US 2019/0334259 A1 Oct. 31, 2019

(51) Int. Cl.
*H01R 9/22* (2006.01)
*H01R 4/48* (2006.01)

(52) U.S. Cl.
CPC ..... *H01R 9/223* (2013.01); *H01R 4/4818* (2013.01)

(58) Field of Classification Search
CPC ..... H01R 9/223; H01R 4/4818
USPC ..... 439/773.1, 441, 188; 174/652, 656
See application file for complete search history.

(56) References Cited

U.S. PATENT DOCUMENTS 6,146,217 A * 11/2000 Osada ..... H01R 4/4836 439/835
6,341,989 B1 * 1/2002 Jaag ..... H01R 4/4827 439/725
6,851,967 B2 * 2/2005 Miyoshi ..... H01R 4/4836 439/441
7,287,999 B2 * 10/2007 Holterhoff ..... H01R 4/4836 439/441
8,113,858 B1 * 2/2012 Chiang ..... H01R 13/701 439/188
8,251,738 B2 * 8/2012 Heckert ..... H01R 4/4836 439/441
8,262,422 B1 * 9/2012 Chiang ..... H01R 4/4836 439/441
8,444,443 B2 * 5/2013 Schafmeister ..... H01R 4/4836 439/441
8,475,191 B2 * 7/2013 Schafmeister ..... H01R 4/4836 439/266
8,579,651 B2 * 11/2013 Hanning ..... H01R 4/4836 439/441
9,276,331 B2 * 3/2016 Stadler ..... H01R 4/4836
9,413,082 B2 * 8/2016 Gassauer ..... H01R 4/4836
9,466,894 B2 * 10/2016 Wu ..... H01R 4/4836
9,466,911 B1 * 10/2016 Wu ..... H01R 4/4836
9,624,951 B2 * 4/2017 Wu ..... F16B 2/22
(Continued)

*Primary Examiner* — Peter G Leigh
(74) *Attorney, Agent, or Firm* — Sinorica, LLC

(57) ABSTRACT

The present invention relates to a terminal stand, particularly, to a terminal stand with a base body, a movable part and a metal elastic part. The base body includes a casing and a side cover. One end of the movable part is a pressing end, the other end extends to form two arms. The metal elastic part is disposed in the accommodating space, one end of the metal elastic part has two abutments, one of the abutments passes through the first through hole and abut against one of the abutment holes, the other abutment passes through the second through hole and abuts against the other abutment hole, the other end of the metal elastic part has two pins, and at least one leg respectively passes through the corresponding pin hole.

10 Claims, 7 Drawing Sheets

(56) References Cited

U.S. PATENT DOCUMENTS

| | | | | |
|---|---|---|---|---|
| 9,680,237 | B2 * | 6/2017 | Aporius | H01R 4/4836 |
| 2017/0331201 | A1 * | 11/2017 | Wu | H01R 4/4818 |

* cited by examiner

TERMINAL STAND WITH MOVABLE PART THAT CAN ACTIVATE A METAL ELASTIC PART

FIELD OF THE INVENTION

The present invention relates a terminal, particularly, to a terminal with a movable part that can be pressed to push down a metal elastic part. This increases an accommodating space for a conducting wire to enter from a passage bore and to go deeper into the space vacated after the elastic part is pressed down. After the movable part is released, the metal elastic part lifts up and clamps the conducting wire.

BACKGROUND OF THE INVENTION

In general, most commonly seen electrical connections between electronic devices rely on a conducting wire to be established, wherein the conventional connection method is to solder the conducting wires to the electronic components, or screw-lock them which are inconvenient to install.

Therefore, the present invention strives to move towards a more convenient way of installing the conducting wire, in order to offer a solution to the aforementioned problem of connecting methods and installation of electrical connections.

SUMMARY OF THE INVENTION

In view of the problems of the above-mentioned convention technology, the present invention has the goal of providing the terminal in order to solve the problems related to pre-existing technologies.

In view of the aforementioned goal, the present invention offers the terminal used for connecting conducting wires. The terminal includes a base body, a movable part and the metal elastic part. The base body includes a casing and a side cover; the casing has the accommodating space; the accommodating space forms an opening on one side of the casing. The other side of the casing has a first through hole, and the bottom surface of the casing has at least one pin hole. One end of the casing has a passage bore used for being passed through by the conducting wire, the passage bore and the accommodating space are communicated each other; the side cover is connected to one side of the casing forming the opening and covers the opening, the side cover has a second through hole corresponding to the first through hole. One end of the movable part is the pressing end and the other end is extended to form two arms, one of the arms is coupled to the other side of the casing having the first through hole, and the inner side of the two arms respectively corresponds to the first through hole and the second through hole to form the abutment hole. The metal elastic part is disposed in the accommodating space, one end of the metal elastic part has two abutments, one of the abutments passes through the first through hole and abuts against one of the abutment holes, the other abutment passes through the second through hole and abuts against the other abutment hole, the other end of the metal elastic part has at least one pin, and at least one pin respectively passes through the corresponding pin hole.

Preferably, the side of the casing may have a plurality of engagement parts.

Preferably, the side cover may have a plurality of engagement holes corresponding to the plurality of engagement parts.

Preferably, the other side of the casing may have a shaft hole.

Preferably, the side cover may have the other shaft hole corresponding to the shaft hole of the casing.

Preferably, the two arms have axis parts respectively corresponding to the shaft hole of the casing and the other shaft hole of the side cover.

Preferably, two sides of the casing extend toward the top end to form an extension part.

Preferably, the two arms may respectively abut against the corresponding extension parts before the two arms are pressed.

Preferably, the metal elastic part may have a bent portion, two ends of the bent portion respectively extend to the end of the metal elastic part having two abutments and the other end having at least one pin.

Preferably, the casing may have a limiting convex portion, the metal elastic part is set up around the limiting convex portion.

The present invention is the terminal with a movable part that can be pressed to push down a metal elastic part. This increases the accommodating space for a conducting wire to enter from the passage bore and to go deeper into the space vacated after the elastic part is pressed down. After the movable part is released, the metal elastic part lifts up and clamps the conducting wire so as to achieve a more efficient method of connecting the conducting wire.

DETAILED DESCRIPTION OF THE PREFERRED EMBODIMENTS

Figure 1:
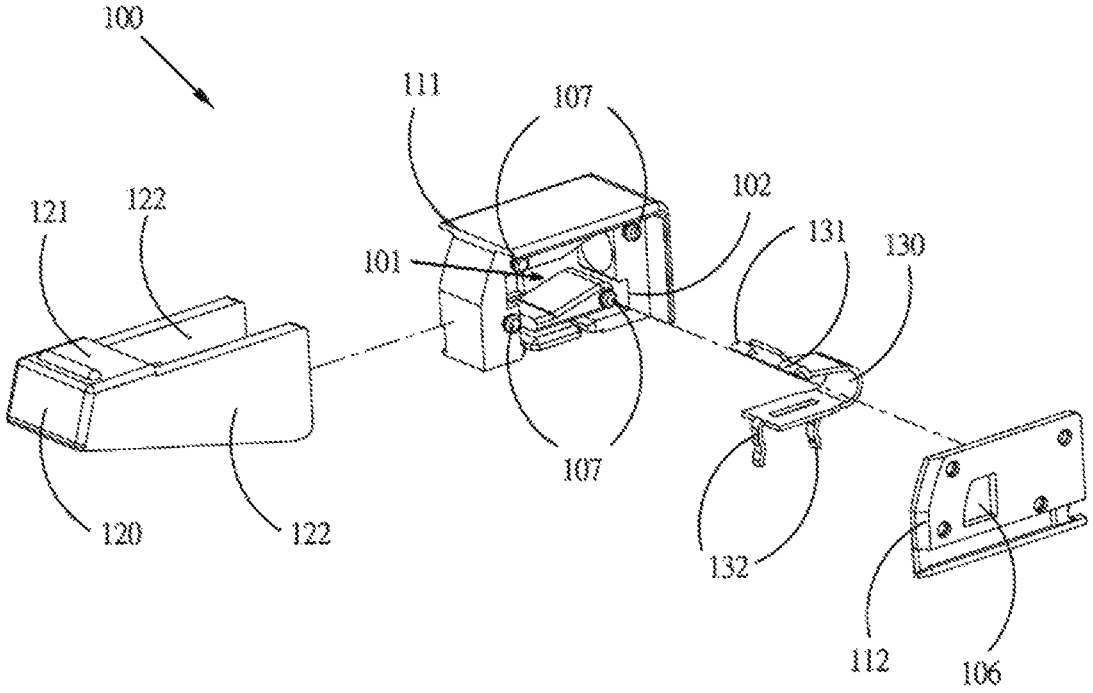
FIG. 1 is the exploded view of the terminal of the present invention.

In order to better understand this invention, its content and the efficacy it can achieve, the invention is explained with the attached figures, and the following is a detailed description of the embodiments. The schematics used in the drawings are only for the purpose of illustration and complementation. It is not intended to be a true proportion and precise configuration of the implementation of the present invention. Therefore, it would not be proper to interpret the proportion and configuration of the illustrations as such, and to limit the scope of rights and actual usage of this invention.

The advantages and characteristic features of the present invention as well as the achieved technology use the reference implementation and all the attached figures to conduct a more in depth description and be more easily understandable; moreover the present invention can be realized in different shapes, therefore it should not be understood as limited to the implementation described in the present state; on the contrary, for those who possess general knowledge of the technological field, the implementation hereby shown will make it possible for the present disclosure to more thoroughly express the domain of the present invention;

moreover, the present invention is exclusively defined by the attached patent application area.

Figure 2:
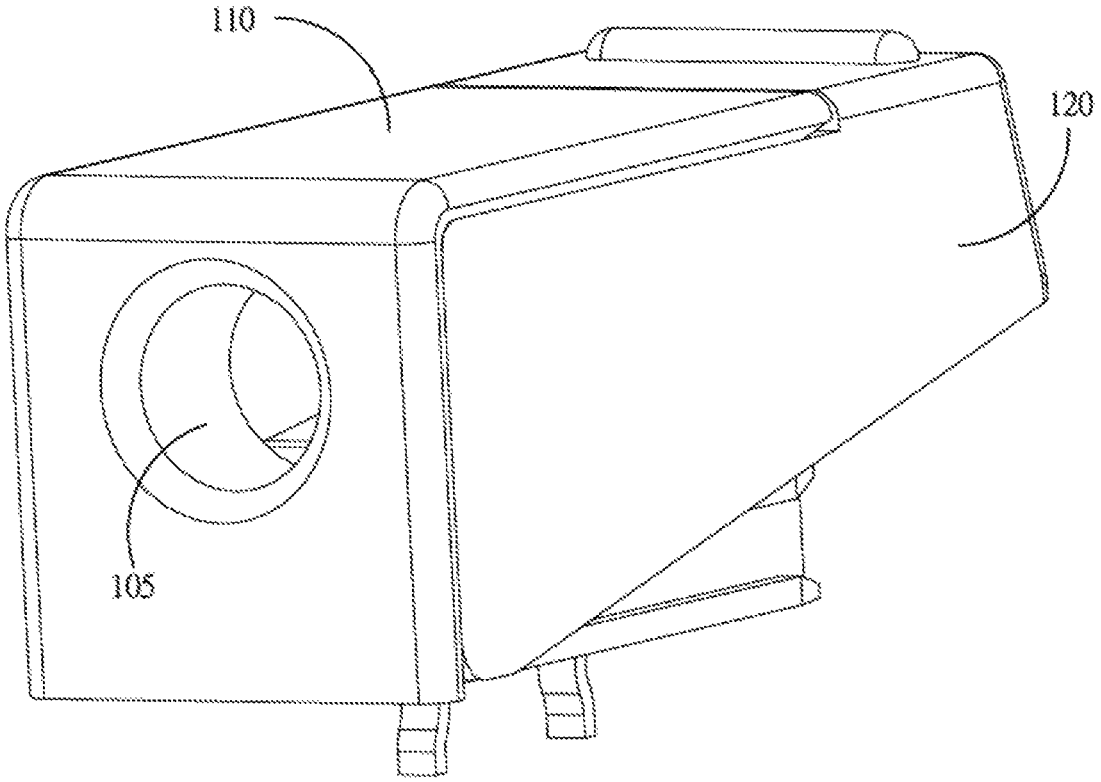
FIG. 2 is the schematic view of the terminal of the present invention.
Figure 3:
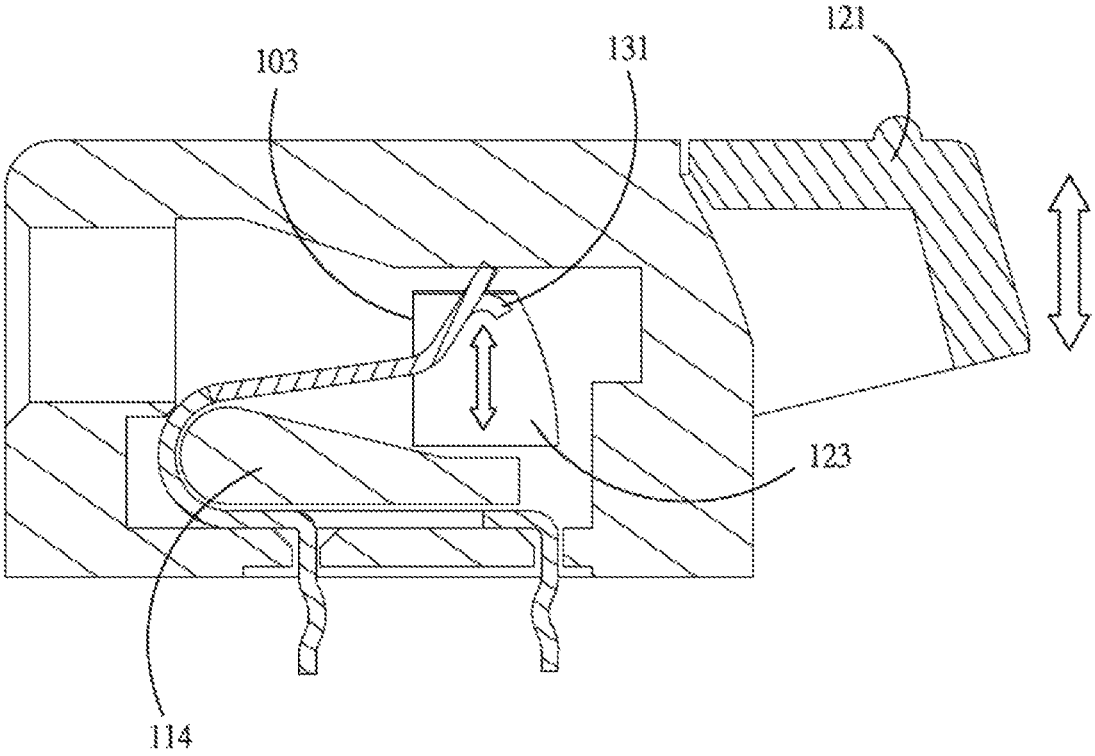
FIG. 3 is the sectional view of the terminal of the present invention.
Figure 4:
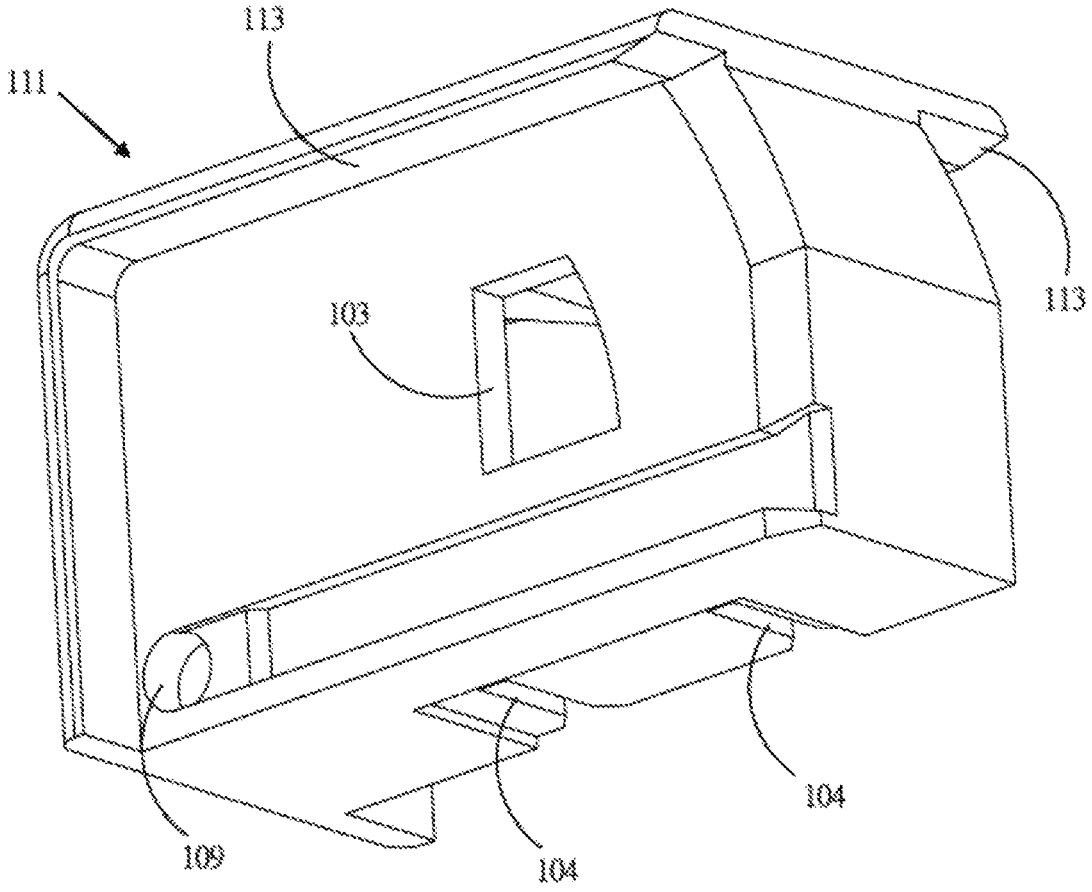
FIG. 4 is the schematic view of the casing of the terminal of the present invention.
Figure 5:
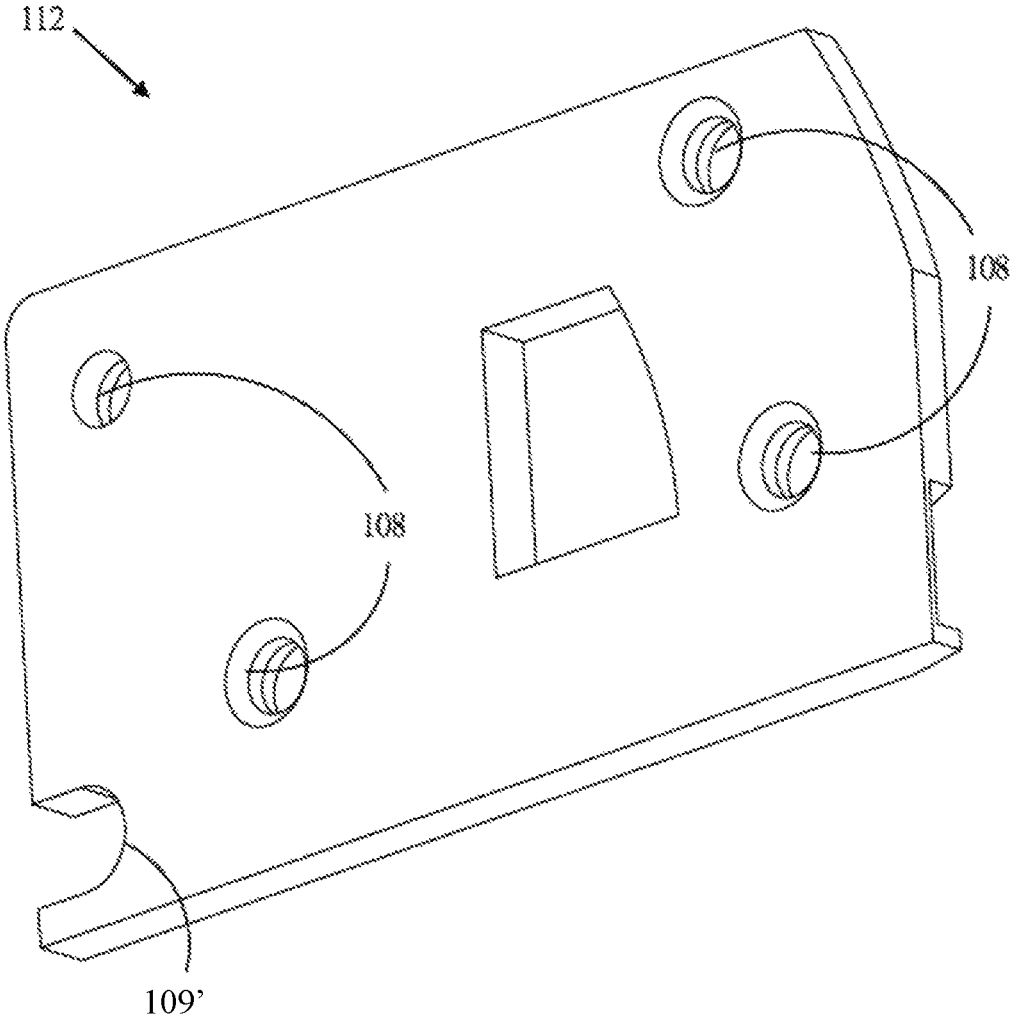
FIG. 5 is the schematic view of the side cover of the terminal of the present invention.
Figure 6:
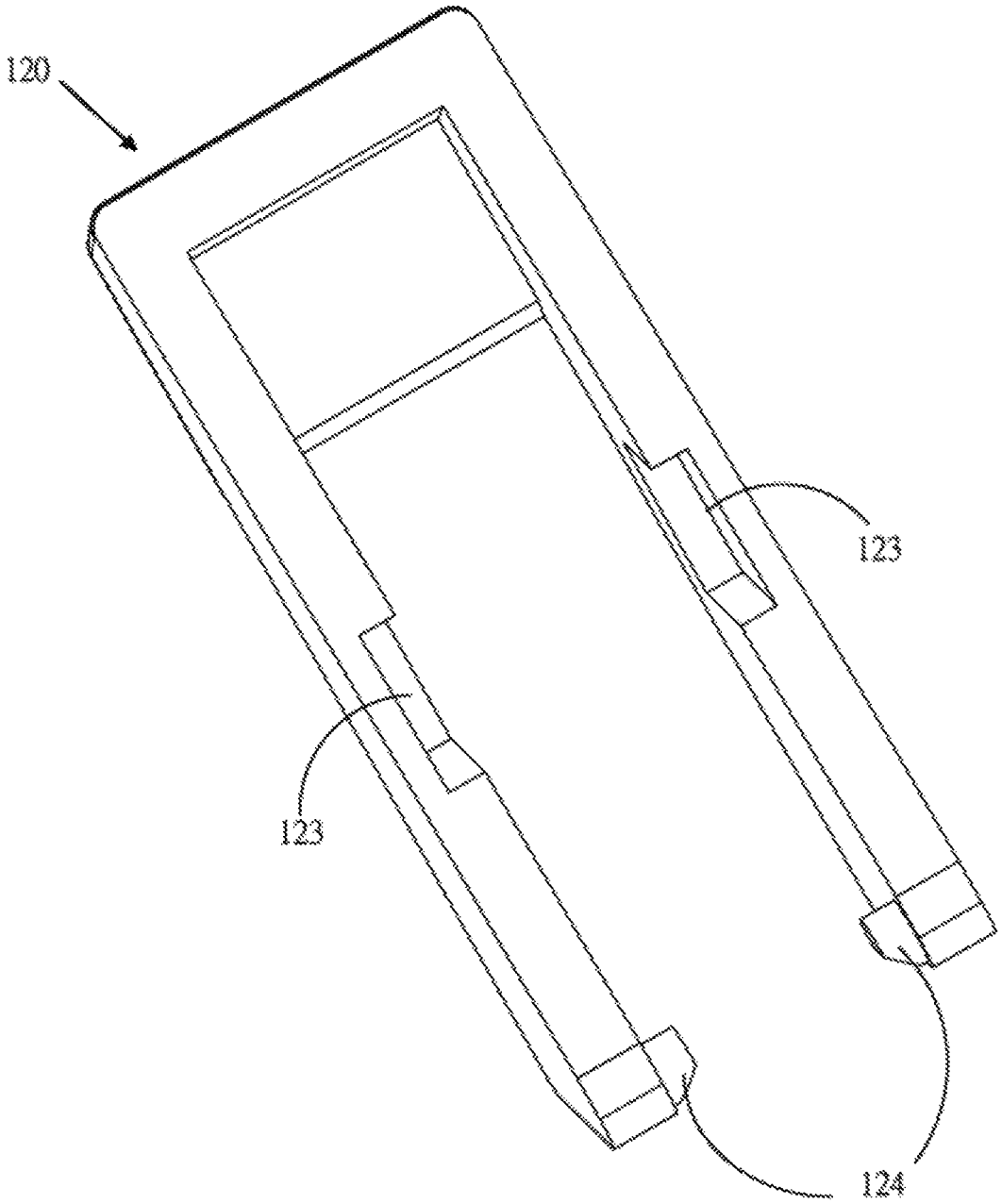
FIG. 6 is the schematic view of the movable part of the terminal of the present invention.
Figure 7:
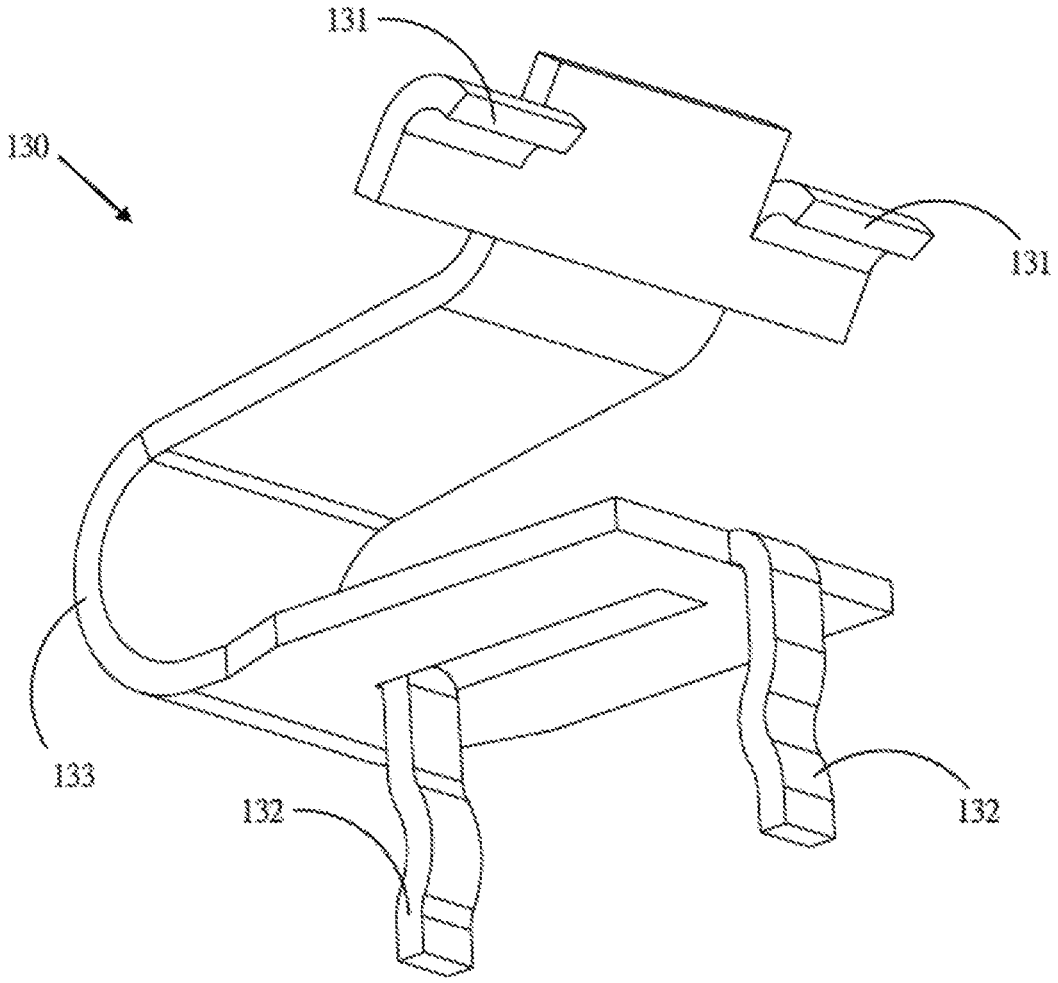
FIG. 7 is the schematic view of the metal elastic part of the terminal of the present invention.

Please refer to FIG. 1 to 7; FIG. 1 is the exploded view of the terminal of the present invention; FIG. 2 is the schematic view of the terminal of the present invention; FIG. 3 is the sectional view of the terminal of the present invention; FIG. 4 is the schematic view of the casing of the terminal of the present invention; FIG. 5 is the schematic view of the side cover of the terminal of the present invention; FIG. 6 is the schematic view of the movable part of the terminal of the present invention; FIG. 7 is the schematic view of the metal elastic part of the terminal of the present invention. As shown in FIGS. 1 to 7, the terminal 100 of the present invention is used to connect to a conducting wire, the terminal 100 includes a base body 110, a movable part 120 and a metal elastic part 130. The metal elastic part 130 is disposed in the base body 110, the movable part 120 is movably displaced reciprocally relative to the base body 110.

Continuing, the base body 110 described above includes a casing 111 and a side cover 112. The casing 111 has an accommodating space 101, the accommodating space 101 forms an opening 102 on one side of the casing on one side of the casing 111. The other side of the casing 111 has a first through hole 103.

Additionally, the bottom of the casing 111 has at least one pin hole 104, one end of the casing 111 has a passage bore 105 used for being passed through by the conducting wire, the passage bore 105 in in communicated with the accommodating space 101.

Therefore, the side cover 112 is connected to the side of the casing 111 forming the opening 102 and covers the opening 102, the side cover 112 has a second through hole 106 corresponds to the first through hole 103.

One end of the movable part 120 is a pressing end 121, the other end extends to form two arms 122, one of the arms 122 is coupled to the side of the casing 111 having the first through hole 103, the other arm 122 is coupled to the side cover 112, and the inner side of two arms 122 respectively corresponds to the first through hole 103 and the second through hole 106 to form an abutment hole 123.

The metal elastic part 130 is disposed in the accommodating space 101, one end of the metal elastic part 130 has two abutments 131, one of the abutments 131 passes through the first through hole 103 and abuts against one of the abutment holes 123, the other abutment 131 passes through the second through hole 106 and abuts against the other abutment hole 123; the other end of the metal elastic part 130 has at least one pin 132, and at least one pin 132 respectively passes through the corresponding pin hole 104. The metal elastic part 130 may have a bent portion 133, and two ends of the bent portion 133 each respectively extend to the end of the metal elastic part 130 having the abutment 131 and the other end having at least one pin 132; additionally, the casing 111 has a limiting convex portion 114, and the metal elastic part 130 is set up around the limiting convex portion 114.

In practical application of the terminal 100 of the present invention, when the conducting wire is to be inserted into the passage bore 105, the pressing end 121 of the movable part 120 is pressed first, such that the movable part 120 is rotationally displaced downward relative to the base body 110. During the rotation, due to abutment hole 123 of the inner side of two arms 122 in the movable part 120 abut against the abutment 131 of the metal elastic part 130. Therefore, when the movable part 120 is rotationally displaced downward, the abutment hole 123 presses down on the abutment 131, which allows one end of the metal elastic part 130 to approach the other end and to free up a space above, and then, when the conducting wire passes through the passage bore 105, it can continue to penetrate into the upper space.

Next, the pressing end 121 can be loosened, and one end of the metal elastic part 130 which is originally pressed down, will be displaced upward due to not being pressed, and further abut against the conducting wire.

As shown in FIG. 4, the side of the casing 111 forming the opening 102 may have a plurality of engagement parts 107, and the side cover 112 may have a plurality of engagement holes 108 corresponding to the plurality of engagement parts 107. When the side cover 112 is connected to the casing 111, each of the engagement holes 108 is engaged with the corresponding engagement part 107.

Continuing to refer to FIG. 4, the other side of the casing 111 may have a shaft hole 109, and the side cover 112 has the other shaft hole 109 corresponding to the shaft hole 109 of the casing 111 (As shown in FIG. 5), the two arms 122 have axis parts 124 respectively corresponding to the shaft hole 109 of the casing 111 and the shaft hole 109 of the side cover 112 (as shown in FIG. 6). When the movable part 120 is coupled to the base body 110, the axis part 124 of one of the arms 122 is coupled to the shaft hole 109 of the casing 111, and the axis part 124 of the other arm 122 is coupled to the shaft hole 109 of the side cover 112. Wherein, the shaft hole 109, 109' is disposed adjacent to one end of the passage bore 105.

Referring to FIG. 4 again, two sides of the casing 111 extend toward the top end to form an extension part 113. When the pressing end 121 of the movable part 120 is not pressed, the movable part 120 will be rotationally displaced upward relative to the base body 110, and two arms 122 will respectively abut against the corresponding extension parts 113, and the movable part 120 stops the rotational displacement. However, the above are only illustrative examples and are not limiting.

According to the above description, terminal of the present invention works by pressing the movable part to press the metal elastic part downwards, resulting in the conducting wire being able, after entering the accommodating space through the passage bore, to penetrate more deeply in the space created by pressing the metal elastic part downwards; after releasing the movable part, the metal elastic part lifts up and clasps the conducting wire, thus achieving a more efficient method of connecting the conducting wire.

The above-mentioned embodiments are merely illustrative of the technical ideas and features of the present invention, and the purpose thereof is to enable those skilled in the art to understand the contents of the present invention and implement them according to the scope of the patent. That is, the equal changes or modifications made by the general in accordance with the spirit revealed by this creation should still be covered by the legal claims of this creation.

What is claimed is:

1. A terminal for connecting a conducting wire, to the terminal comprises:

a base body including:

a casing with an accommodating space, an opening is formed on one side of the casing and at the accommodating space, an other side of the casing has a first through hole, a bottom surface of the casing has at least one pin hole, one end of the casing has a passage bore used for being passed through by the conducting wire, the passage bore is in communicated with the accommodating space;

a side cover connected to the side of the casing forming the opening and covers the opening, the side cover has a second through hole corresponding to the first through hole;

a movable part, an end thereof is a pressing end, the other end is extended to be formed into two arms, one of the arms is coupled to the other side of the casing with the first through hole, the other arm is coupled to the side cover, two abutment holes are formed at an inner side of the two arms and respectively corresponding to the first through hole and the second through hole;

a metal elastic part disposed in the accommodating space, one end of the metal elastic part has two abutments, one of the abutments passes through the first through hole and abuts against one of the abutment holes, the other abutment passes through the second through hole and abuts against the other abutment hole, the other end of the metal elastic part has at least one first pin, and the at least one first pin respectively passes through the corresponding at least one pin hole.

2. The terminal according to claim 1, wherein the side of the casing has a plurality of engagement parts.

3. The terminal according to claim 2, wherein the side cover has a plurality of engagement holes corresponding to the plurality of engagement parts.

4. The terminal according to claim 1, wherein the side casing has a first shaft hole.

5. The terminal according to claim 4, wherein the side cover has a second shaft hole corresponding to the first shaft hole of the casing.

6. The terminal according to claim 5, wherein the two arms have an axis part respectively corresponding to the first shaft hole of the casing and the second shaft hole of the side cover.

7. The terminal according to claim 1, wherein two sides of the casing near a top of the casing are respectively extended to form an extension part.

8. The terminal according to claim 7, wherein the two arms will respectively abut against the corresponding extension parts before the two arms are pressed.

9. The terminal according to claim 1, wherein the metal elastic part have a bent portion, two ends of the bent portion are respectively extend to the end of the metal elastic part having the two abutments and the other end having the at least one pin.

10. The terminal according to claim 1, wherein the casing has a limiting convex portion, the metal elastic part is set up around the limiting convex portion.

* * * * *